United States Patent [19]

Berghgracht

[11] 3,995,410

[45] Dec. 7, 1976

[54] PACKAGE FORMING APPARATUS

[76] Inventor: Marius Leopold Hypolite Berghgracht, Place Joyale, Vineuil sur Firmin pres Chantilly (Oise), France

[22] Filed: Mar. 3, 1975

[21] Appl. No.: 554,511

Related U.S. Application Data

[60] Continuation-in-part of Ser. No. 397,315, Sept. 14, 1973, abandoned, which is a division of Ser. No. 263,208, June 15, 1972, abandoned.

[30] Foreign Application Priority Data

June 15, 1971 Luxembourg ..... 63337

[52] U.S. Cl. ..... 53/159; 53/184 S; 214/10.5 R

[51] Int. Cl.[2] ..... B65B 35/50; B65B 53/02

[58] Field of Search ..... 53/159, 182, 184 S, 53/30 S; 214/6 P, 10.5 R

[56] References Cited

UNITED STATES PATENTS

| | | | |
|---|---|---|---|
| 2,702,642 | 2/1955 | Bensinger | 214/10.5 R |
| 2,896,798 | 7/1959 | Celley | 214/10.5 R |
| 3,640,048 | 2/1972 | Zelnick et al. | 53/184 S |
| 3,727,324 | 4/1973 | Melgaard | 53/184 S |

*Primary Examiner*—Robert Louis Spruill
*Attorney, Agent, or Firm*—Sherman Levy

[57] ABSTRACT

Apparatus for forming a watertight package about one or more articles in such a manner that the package can be easily handled by conventional article handling equipment. The apparatus includes an intermittently operated conveyor means having a plurality of spaced stations at which a palletized package is automatically assembled and covered with a waterproof thermoplastic material which is heat sealed and caused to shrink into intimate engagement with the articles being packaged.

2 Claims, 3 Drawing Figures

PACKAGE FORMING APPARATUS

CROSS REFERENCE TO RELATED APPLICATIONS

This application is a continuation-in-part of application Ser. No. 397,315, filed Sept. 14, 1973, now abandoned, which was a division of application Ser. No. 263,208, filed June 15, 1972, now abandoned.

FIELD OF THE INVENTION

The invention relates to an apparatus for packaging products such as cement bags, beer or oil cases, food products, or any other items likely to constitute a geometric volume suitable for stacking.

DESCRIPTION OF THE PRIOR ART

It is conventional in the industry to place a plurality of articles on a pallet in a desired order to provide a package having a volume which can be easily handled by means of a fork lift or the like. It is also conventional to wrap such a package with a covering made from a retractable film so that bundling or strapping operations by means of steel or plastic ribbons are unnecessary. Although these packages have been an improvement over what was formerly made, they have the drawback of not completely and tightly sealing the package, which can be detrimental to the wrapped products, particularly if the product is food or any other perishable product which must necessarily be protected from dampness.

Furthermore, since such packages have been of relatively high cost, some efforts have been made to construct the pallets of inexpensive materials so that they may be regarded as disposable. However, these pallets, in spite of their low cost, have considerably raised the cost of the packages which resulted in increasing the price of products delivered to the consumers.

SUMMARY OF THE INVENTION

The invention is embodied in an apparatus for packing products in a compact package which can be handled by means of a fork lift or the like and includes an intermittently operated conveyor means having a belt with a multiplicity of upstanding, segmented units defining a plurality of open channels. At spaced succeeding stations along the belt, substantially hollow feet are placed in the channels, a first sheet of thermoplastic material is attached to the feet, a plurality of articles is stacked on the first sheet to form a polyhedric volume which is preferably cubical, the upper portions of the articles are covered by a second sheet made of a retractable thermoplastic material which is substantially larger than the upper portion of the package, the edges of the two thermoplastic sheets are connected together, and the package is introduced into a furnace which causes the edges of the sheets to be welded together and causes the sheets to shrink into intimate engagement with the articles to form a waterproof package.

It is an object of the invention to provide an apparatus for forming a waterproof package by providing a plurality of operating stations along an intermittently operated conveyor for automatically assembling a package of stacked articles and covering the stack with a watertight cover in intimate engagement with the articles so that the package can be easily handled by conventional article handling equipment and will be protected from the elements.

Figure 1:
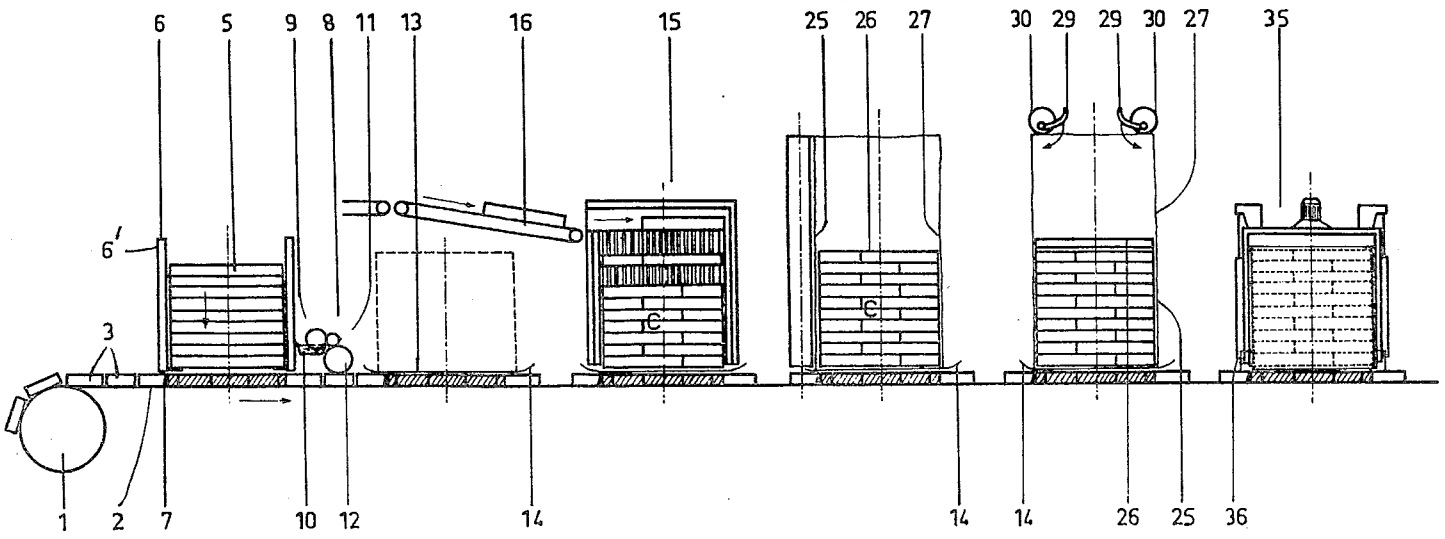
FIG. 1 is a schematic side elevation illustrating one embodiment of the invention.

With continued reference to the drawings, the invention includes a conveyor unit 1, having a belt 2 passing through a series of operating stations. The conveyor belt 2 has on its upper surface three rows of transversely spaced, upstanding segmented units 3 in spaced end to end relationship with each other and forming continuous channels or spaces 4 which receive feet or support members 5. These feet are located generally parallel to each other within the channels 4 and are spaced apart a distance substantially corresponding to the distance between the two arms of a fork lift apparatus. Although the feet or support members 5 may have either a closed or open section without changing the principle of the invention, such feet are preferably of hollow tubular construction of a size to receive the forks of a fork lift or the like. The feet 5 must be at least as high as units 3 for reasons which will be described later on. Such feet can be made of any material, for example, of molded plastic materials, wood or the like. Due to their low cost, the feet can be regarded as disposable or, if desired, can be recovered and reused.

The conveyor belt passes first through a feeding station 6 having guides 6' within which the feet 5 are piled in two generally vertical stacks and such feet are located in a plane generally parallel to the direction of movement of the conveyor belt. At the feeding station, the lowermost foot of each stack is engaged by upstanding lugs 7 carried by the conveyor belt and disposed in a position to move through the channels 4. The lugs 7 move the lowermost feet out of the feeding station 6 while the remainder of the stacks of feet are retained in position by the guides 6'. After the lowermost feet have been moved, the stacks drop down by gravity so that the conveyor in a position to be engaged by the next set of lugs 7.

The feet which are removed from the feeding station are carried by the belt 2 to a glueing station 8. The glueing station includes a first roll 9 rotating in a glue container 10 for picking up therefrom a film of glue, a second roll 11 for receiving glue from the first roll and transmitting this film of glue to a third roll 12 which contacts the upper face of the feet 5. The rolls may either have a width corresponding to that of the feet 5 so as not to glue the upper face of the units 3 or may have a width equal to that of the conveyor belt; but, in that case, the height of the units must be slightly lower than the height of the feet.

The feet, thus glued and driven by the lugs 7, pass through a base applying station where a base sheet 13 is placed on the feet 5 in any conventional manner either manually or mechanically. This base sheet can be a retractable thermoplastic material or a flexible material coated with plastic. The base sheet 13 is glued to the feet 5 and has a larger surface than the actual lower surface of the package to be obtained so that the peripheral border 14 of the base sheet subsequently can be fixed to the vertical walls of the cover surrounding the package. When the base sheet 13 is in position, the conveyor belt is started again so that the base sheet is moved to a loading station 15.

At this station, the package (generally referenced C) is made by piling successive layers of the articles, according to a rational schedule similar to masonry. This loading can be accomplished, as shown in FIG. 1, by means of a conveyor belt 16 feeding successive layers of articles onto the base sheet 13, until the desired volume is completed.

This volume is necessarily polyhedric, for example cubic, and it is to be noted that the stopping time of the conveyor belt is equal to the time necessary for making a package by means of the loading apparatus.

Figure 2:
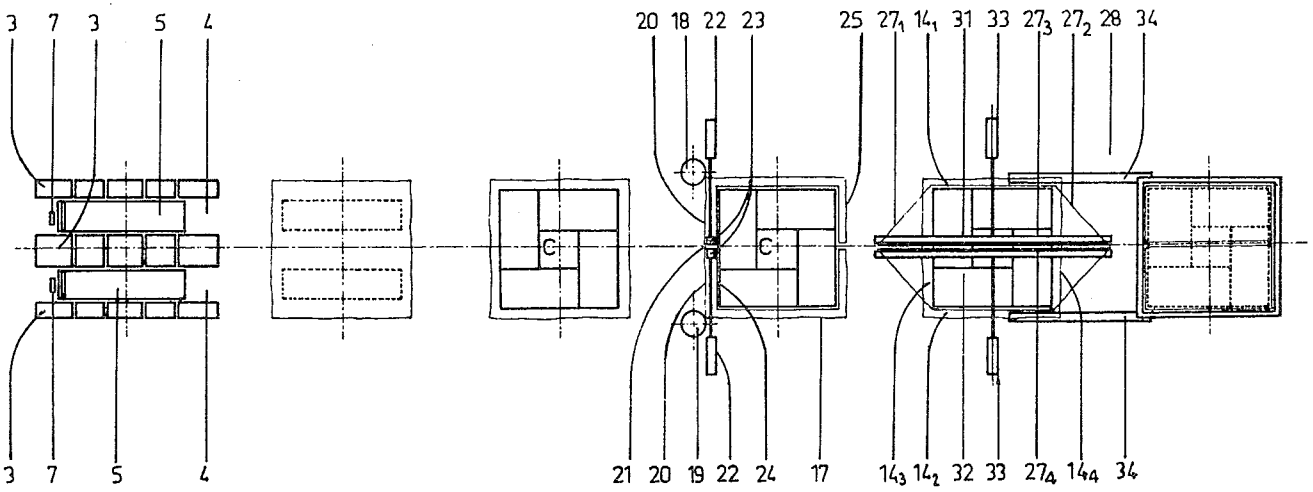
FIG. 2 is a top plan view thereof.
Figure 3:
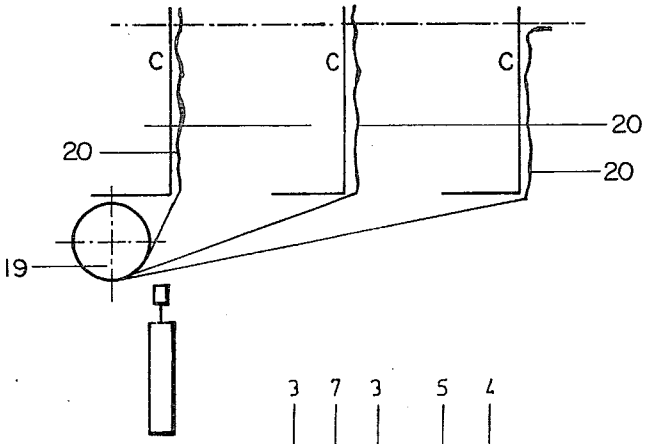
FIG. 3 is a schematic side elevation showing the steps of forming the peripheral portions of a package.

The base sheet 13 and the stacked articles are then carried to a covering station 17 (FIG.2) where a peripheral covering is formed around the articles. This covering is made from two rolls 18 and 19, located on opposite sides of the conveyor belt and which extends upwardly substantially above the stack of articles. Each of the rolls 18 and 19 unwinds a film of retractable or heat shrinkable plastic material 20, whose vertical edges are connected together at 21, so as to form a transverse screen obstructing the passage of the package carried by the conveyor belt. When the package reaches this screen, such package carries the screen forward, as shown in FIG. 3, thus unwinding the plastic film from rolls 18 and 19 until the unwound length is sufficient for completely surrounding the four vertical walls of the package.

A pair of lateral jacks 22 are located on opposite sides of the conveyor belt and each of such jacks includes heating jaws for welding the covering. These jacks engage the sides of the plastic material films and are extended inwardly so that such plastic films surround the back face 24 of the package to fully close the loop surrounding the four vertical walls of said package. When the loop is thus closed, the heating jaws 23 weld the opposed portions of the film to each other, after which knives (not shown) cut the welded zone along a vertical plane so as to form again a screen for the next package to come. Of course, the jacks 22 and the heating jaws 23 are actuated by contacts which are energized by the displacement of the package.

The peripheral covering 25 surrounds the package, (FIG. 1), and extends above the upper level 26 of the package so that the upper border 27 subsequently may be used to form its upper face. The border 27 must at least have a height equal to a half-width of the package, in addition to the width necessary for welding the two horizontal edges of the covering.

The package, thus wrapped, is moved by the conveyor belt to a top forming station 28 where the top of the covering is closed. At this station, the peripheral border 27 of the covering is turned down and folded on the top 26 of the package by means of fingers 29 which are integral with eccentric cams 30. Such fingers, by pivoting towards the exterior, move the two opposite edges $\mathbf{27_1}$ and $\mathbf{27_2}$ of the border of the covering away from each other in order to form two triangle-shaped bellows, which places the two other edges $\mathbf{27_3}$ and $\mathbf{27_4}$ of the covering opposite in engagement with each other so that they can be welded. This folding of the upper part of the covering, in the shape of the bottom of a paper bag, is obtained by the combined action of the fingers 29 with two heating blades 31 and 32, operating in a plane perpendicular to the direction of movement of the conveyor belt. These blades are actuated by jacks 33 and are substantially as long as the covering so as to weld the two edges $\mathbf{27_3}$ and $\mathbf{27_4}$ along their entire length with such welding being made along the median plane of the package.

At this stage, the package is closed and tightly wrapped on five of its six sides, and it only remains to connect the peripheral edge 14 of the base sheet 13 with the vertical walls of the covering to obtain a fully closed waterproof package.

The connection between the base sheet and the peripheral covering is obtained by raising the peripheral border 14 of the base sheet along the two lateral sides $\mathbf{14_1}$ and $\mathbf{14_2}$ (see FIG. 2) by means of a pair of guides 32, located on opposite sides of the conveyor belt. Such guides have helical configurations so that the threads progressively raise the two lateral sides $\mathbf{14_1}$ and $\mathbf{14_2}$ of the base sheet to a plane parallel to that of the covering 25. The two other edges $\mathbf{14_3}$ and $\mathbf{14_4}$ of the base sheet are also raised to a plane generally parallel to the covering by suitable mechanical means or streams of air located in a plane perpendicular to the conveyor belt.

The package is then moved to a sealing station having a retraction furnace 35. Such furnace has a high heat zone located adjacent to the lower part of the package, as indicated at 36 (FIG. 1), to seal the edge 14 of the base sheet to the lower portion of the vertical wall of the covering 25. The remainder of the furnace is provided with low heat zones which cause the heat retractable plastic films to shrink into intimate engagement with the articles.

The installation of the present invention is constituted by a conveyor belt formed by three rows of pins delimiting two channels in which are placed the sections designed subsequently to receive a base sheet, and then the articles. The sections serving for palletization of the parcels are integral with the envelope of retractable synthetic material and form a whole with the packaged material.

A station for covering the lateral and upper walls follows the loading station. Two rollers of which the axis is placed perpendicularly to the conveyor each supply a film which is welded vertically in the median part of the path followed by the parcel so as to form a screen in front of this parcel. In moving, the parcel carries along the film in a length sufficient to envelope entirely the vertical walls of the parcel. The film largely exceeds the height of the parcel, in order to be able subsequently to form the upper face of the envelope. Two lateral jacks 22 comprising two heating jaws 23 enable the film to be welded behind the following parcel giving a double weld; the film is then cut out between the two welds in the direction of the height so that it forms a new screen for the following parcel.

A folding and top forming station of the parcel follows the covering station. To form the top of the parcel, the film surrounding the lateral walls is folded by simultaneously pivoting the fingers 29 mounted eccentrically on the cams 30 and by moving the heating blades 31 and 32 towards the median part of the parcel. The fingers 29, by rotating, enable the film to be pulled, along the axis of the conveyor, in a fashion such that the upper edges of the film of the left hand and right hand lateral walls approach one another in order to facilitate the simultaneous action of the heating blades 31, 32, actuated by the jacks 33.

Lastly, the article is brought to the final covering station where the envelope of synthetic material is retracted.

The essential advantage of this installation is to enable articles to be wrapped continuously or intermittently which gains considerable time and enables a non-returnable packing to be obtained. Such packaging allows easy handling and provides great safety for the product transported or bound.

The retracted cover binds the articles into a compact waterproof package without a pallet which allows it to be handled, filed and preserved due to the watertightness of the wrapping.

The retractable plastic material can be of any suitable thermoplastic material such as PVC, and the temperature of the retraction furnace for contracting the material without destroying its mechanical characteristics may vary from approximately 200° to 250° C.

I claim:

1. Apparatus for forming and covering a package of stacked articles comprising conveyor means having an intermittently driven belt, a multiplicity of laterally spaced generally parallel upstanding segmented units mounted on said belt, said segmented units being arranged in longitudinal end to end relationship and defining at least two parallel channels extending lengthwise of said belt, a plurality of spaced upstanding lugs mounted on said belt between said segmented units, a feeding station located above said belt, said feeding station including a plurality of guide means, at least two stacks of individual support members located above said channels and fed by gravity so that the lowermost support members engage said belt, said lugs engaging and removing the lowermost support means from each stack when said belt is driven, a gluing station located adjacent to said feeding station, means at said gluing station for applying adhesive to the upper surface of each of said support members, a base applying station spaced from said feeding station, a sheet of flexible thermoplastic material being placed on said support members at said base applying station so that said sheet is bonded to said support members, a loading station spaced from said base applying station, means for supplying a plurality of articles to said loading station so that said articles may be placed in stacked realtionship on said base sheet, a covering station spaced from said loading station, said covering station including a pair of generally vertically disposed rolls of heat retractable thermoplastic material located on opposite sides of said belt, means for sealing said plastic material together to form a screen extending across said belt in a position to be engaged by the leading face of said stacked articles, means for closing said screen about the trailing face of said articles, said covering material extending substantially above said articles, a top forming station spaced from said covering station along said belt, means at said top forming station for folding the upper portions of said covering material together and sealing the same, means for raising portions of said base sheet into engagement with the lower portions of said covering material, a sealing station spaced from said top forming station along said belt, and means at said sealing station for sealing said base sheet to said covering material and causing said covering material to shrink into intimate engagement with said articles, whereby a sealed watertight package is formed around a stack of articles mounted on spaced feet.

2. The apparatus as defined in claim 1 in which said means for closing said screen about the trailing face of said articles includes a pair of opposed extendable and retractable jacks.

* * * * *